US007133271B2

(12) United States Patent
Jonas et al.

(10) Patent No.: US 7,133,271 B2
(45) Date of Patent: Nov. 7, 2006

(54) SWITCHGEAR WITH EMBEDDED ELECTRONIC CONTROLS

(75) Inventors: John P. Jonas, Greendale, WI (US); Veselin Skendzic, Pullman, WA (US); Richard G. Rocamora, Waukesha, WI (US); Michael P. Dunk, Caledonia, WI (US)

(73) Assignee: McGraw-Edison Company, Houston, TX (US)

( * ) Notice: Subject to any disclaimer, the term of this patent is extended or adjusted under 35 U.S.C. 154(b) by 0 days.

(21) Appl. No.: 10/743,346

(22) Filed: Dec. 23, 2003

(65) Prior Publication Data

US 2005/0135030 A1 Jun. 23, 2005

(51) Int. Cl.
*H01H 73/00* (2006.01)

(52) U.S. Cl. ..... 361/115

(58) Field of Classification Search ..... 361/115, 361/64, 71, 93.2, 131
See application file for complete search history.

(56) References Cited

U.S. PATENT DOCUMENTS

| | | | | |
|---|---|---|---|---|
| 4,367,900 | A * | 1/1983 | Trumper | 299/1.6 |
| 4,814,712 | A * | 3/1989 | Burton et al. | 324/424 |
| 4,870,531 | A * | 9/1989 | Danek | 361/93.1 |
| 6,112,535 | A * | 9/2000 | Hollenbeck | 62/228.4 |
| 6,271,759 | B1 * | 8/2001 | Weinbach et al. | 340/635 |
| 6,529,013 | B1 | 3/2003 | Skendzic et al. | |
| 6,687,110 | B1 * | 2/2004 | Murray | 361/131 |
| 6,766,143 | B1 | 7/2004 | Beckwith | 455/66.1 |

* cited by examiner

*Primary Examiner*—Stephen W. Jackson
*Assistant Examiner*—Boris Benenson
(74) *Attorney, Agent, or Firm*—Armstrong Teasdale LLP

(57) ABSTRACT

In one general aspect, a system to control and monitor an electrical system includes a switchgear housing unit connected to the electrical system that includes a switchgear mechanism for controlling a connection within the electrical system and electronic controls for monitoring and controlling the switchgear mechanism, where the electronic controls are embedded within the switchgear housing unit to form a single, self-contained unit.

30 Claims, 5 Drawing Sheets

SWITCHGEAR WITH EMBEDDED ELECTRONIC CONTROLS

TECHNICAL FIELD

This document relates to a switchgear with embedded electronic controls.

BACKGROUND

In conventional implementations, a high voltage switchgear and its associated electronic controls are physically separated. Typically, the switchgear sits near the top of a utility pole while the electronic controls are mounted in a cabinet closer to the ground. The switchgear and its associated electronic controls are connected by one or more multi-conductor cables that share a common grounding system.

SUMMARY

In one general aspect, a system to control and monitor an electrical system includes a switchgear housing unit connected to the electrical system that includes a switchgear mechanism for controlling a connection within the electrical system and electronic controls for monitoring and controlling the switchgear mechanism, where the electronic controls are embedded within the switchgear housing unit to form a single, self-contained unit.

Implementations may include one or more of the following features. For example, the electronic controls may include an analog-to-digital conversion component that digitizes voltage and current waveforms within the switchgear housing unit. The electronic controls may include a digital interface that receives input from the analog-to-digital conversion component to enable an operator to interface with the electronic controls. A separate enclosure and a digital interface may be included. The digital interface may be housed in the separate enclosure that is connected to the electronic controls embedded within the switchgear housing unit using a multi-connector cable that provides electronic control signals to enable an operator to interface with the electronic controls.

The electronic controls may include an energy storage component embedded within the switchgear housing unit to provide backup power to operate the electronic controls and the switchgear mechanism during a power interruption. The electronic controls may include a programming port to enable an operator to program the electronic controls.

The electronic controls may include a current sensing device to measure current in the electrical system. The system also may include a voltage sensing device to measure voltage in the electrical system, an analog-to-digital converter to digitize the measured current and voltage, a processor device to process the digitized current and voltage measurements, and a memory device to store the digitized current and voltage measurements.

The switchgear housing unit and the embedded electronic controls may be physically located near a top of a utility pole. The switchgear housing unit may include a manual operation device to operate the switchgear mechanism manually. The electronic controls may include a communications module to enable remote management of the switchgear mechanism.

The switchgear housing unit may include a mechanism housing with one or more attached interrupter modules. The interrupter modules may include one or more vacuum interrupters.

The switchgear mechanism may be configured to provide fault isolation to the system. The switchgear mechanism may be configured to provide switching and/or tying operations between connections in the electrical system.

In another general aspect, controlling and monitoring an electrical system includes monitoring the electrical system using electronic controls embedded within a switchgear housing unit and controlling the electrical system using the electronic controls embedded within the switchgear housing unit.

Implementations may include one or more of the following features. For example, the current and voltage of the electrical system may be measured and the current and voltage measurements may be converted to digital current and voltage measurements. Backup power may be provided to the electronic controls using an energy storage module contained within the switchgear housing unit.

The electronic controls may be remotely operated using a communications module contained within the switchgear housing unit. The switchgear mechanism may be manually operated using a manual operation device contained within the switchgear housing unit.

These general and specific aspects may be implemented using a system, a method, or a computer program, or any combination of systems, methods, and computer programs.

Other features will be apparent from the description and drawings, and from the claims.

These general and specific aspects described in the summary above provide advantages over conventional switchgear and electronic control arrangements that are typically more 'expensive,' 'maintenance prone,' and 'sensitive.' For example, although conventional split configuration arrangements of the switchgear and electronic controls attempted to address the perceived 'sensitivity' of early electronic controls, the split configuration arrangements may result in additional exposure to lightning surges and power system transients.

This sensitivity can easily be explained by envisioning a lightning bolt striking the switchgear near the top of the pole. The inherent inductance of the grounding conductor, and the fast rise time associated with the lightning wave, typically results in a significant potential difference of 4 to 15 kV between the switchgear and the electronic control cabinet near the bottom of the pole. The multi-conductor cable interface present between the switchgear and the control will present this potential difference to both the switchgear and the control. The high voltage potentials generated by the lightning strike are capable of destroying the attached electronic circuitry, and have over time resulted in the addition of extensive and costly 'surge protection networks' at both ends of the multi-conductor cable interface. Having the electronic controls embedded in the switchgear housing results in reduced sensitivity to lightning surges and power system transients and results in reduced costs for surge protection.

In addition to the surge sensitivity and the resulting costly surge protection, the use of conventional wiring to carry individual signals creates an additional problem. Every time a particular function needs to be added to the system, the number of wires necessary to carry new signals increases in proportion to the number of functions added. For example, to add voltage measurements to both sides of the switchgear, a minimum of 7 wires (often as many as 12) may be required to bring the new signals to the electronic controls. This conductor proliferation adds additional cost to the design. By using electronic controls that are embedded within the switchgear housing, the wiring problems associated with conventional switchgear arrangements may be greatly reduced or eliminated entirely.

In addition to the cost savings, embedding the electronic controls within the housing of the switchgear enables the addition of a backup power system to the switchgear. The backup power system enables the switchgear to operate during a power failure and to attempt to bypass or correct the power failure. The backup power system is able to supply power to the electronic controls because the backup power system and the electronic controls are tightly coupled within the switchgear housing. Enabling the switchgear to operate during a power failure minimizes the duration for which the effects of a power failure are felt.

DESCRIPTION OF DRAWINGS

Like reference symbols in the various drawings indicate like elements.

DETAILED DESCRIPTION

Figure 1:
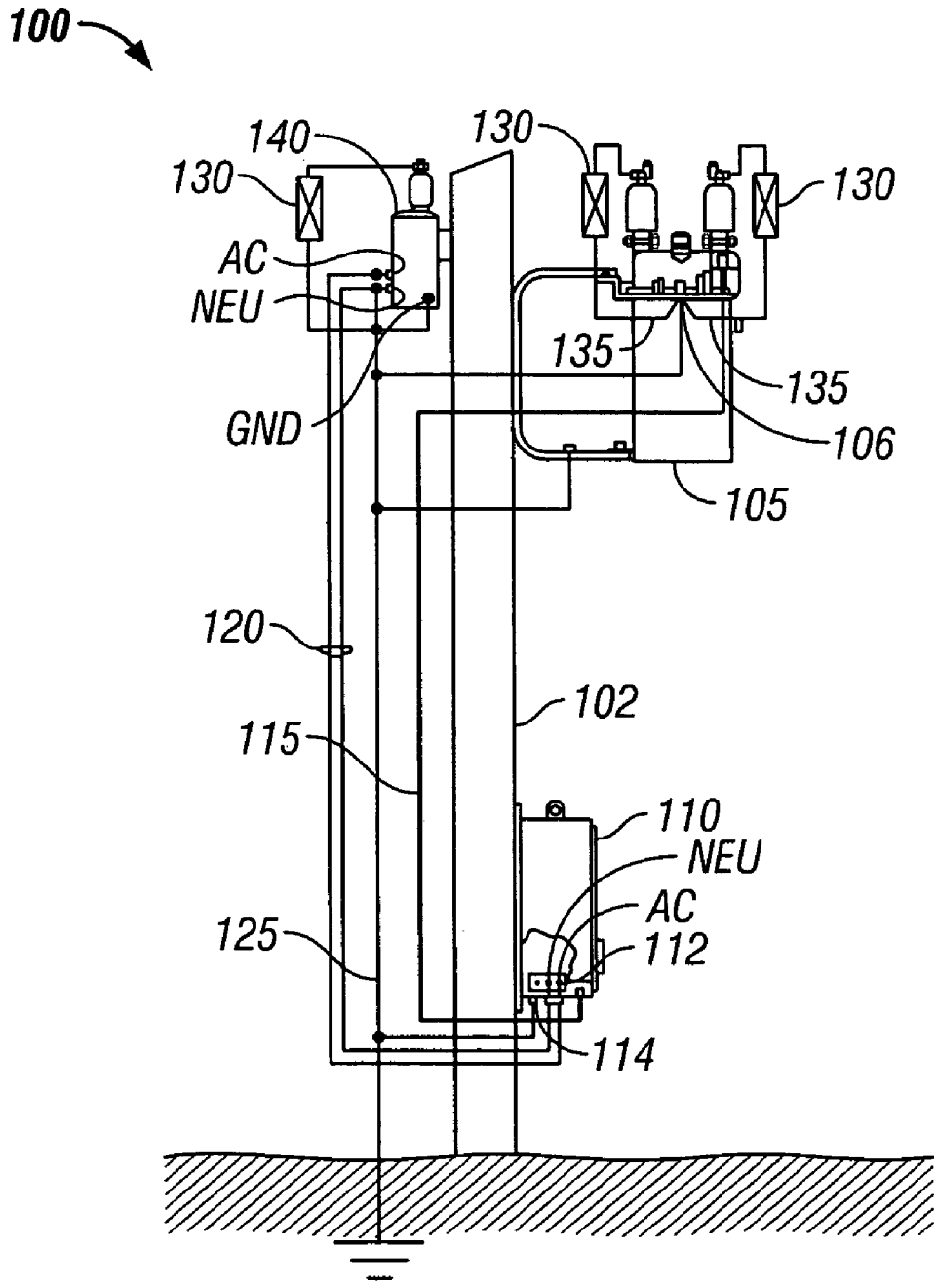
FIG. 1 PRIOR ART
FIG. 1 is an illustration of a conventional switchgear and electronic controls.

Referring to FIG. 1, a conventional high voltage electrical system 100 at a utility pole 102 includes a switchgear 105 that is connected to electronic controls 110 by a control cable 115. The switchgear 105 is mounted near the top of a utility pole 102. In general, the switchgear 105 is part of a system for controlling and monitoring the operation of the electrical system 100 by providing fault protection to open and/or isolate problem areas based on trouble that may be sensed by a remotely-located protective relay, a controller, or the switchgear 105 itself. The switchgear 105 may include assemblies of switching or interrupting devices, along with control, metering, protective, and regulating devices. For example, the switchgear may be a recloser, a switch, or a breaker. In one implementation, the switchgear may provide switching and/or tying operations between connections of the electrical system 100. The switchgear 105 includes a switchgear head ground 106 that connects the switchgear 105 to ground.

The electronic controls 110 are located near the bottom of the pole 102. The electronic controls 110 include an input terminal block 112 and a customer ground connection at an external lug 114. The electronic controls 110 also include an interface and other electronic circuitry through which a user can monitor and control the operation of the switchgear 105. Information and commands are sent between the electronic controls 110 and the switchgear 105 by way of the control cable 115. Thus, in the conventional high voltage electrical system 100, the switchgear 105 and the electronic controls 110 that enables control of the switchgear 105 are physically separated, with the switchgear 105 being near the top of the pole 102 and the electronic controls 110 being near the bottom.

A supply voltage cable 120 and a pole ground cable 125 also connect to the electronic controls 110. The supply voltage cable 120 connects at the input terminal block 112, while the pole ground cable 125 connects at the customer ground connection at an external lug 114.

The pole ground cable 125 also connects to surge arresters 130 by way of the surge arrester ground cable 135. The surge arresters are included in the high voltage switchgear system 100 to prevent high potentials generated by lightning strikes or switching surges from damaging the switchgear 105 or the electronic controls 110. The control cable 115, the supply voltage cable 120, and the pole ground 125 all run over the entire length of the pole 102.

A transformer 140 is connected to the input terminal block 112 of the electronic controls 110 through the supply voltage cable 120. The electronic controls 110 and the transformer 140 also share a common connection to the pole ground cable 125.

Figure 2:
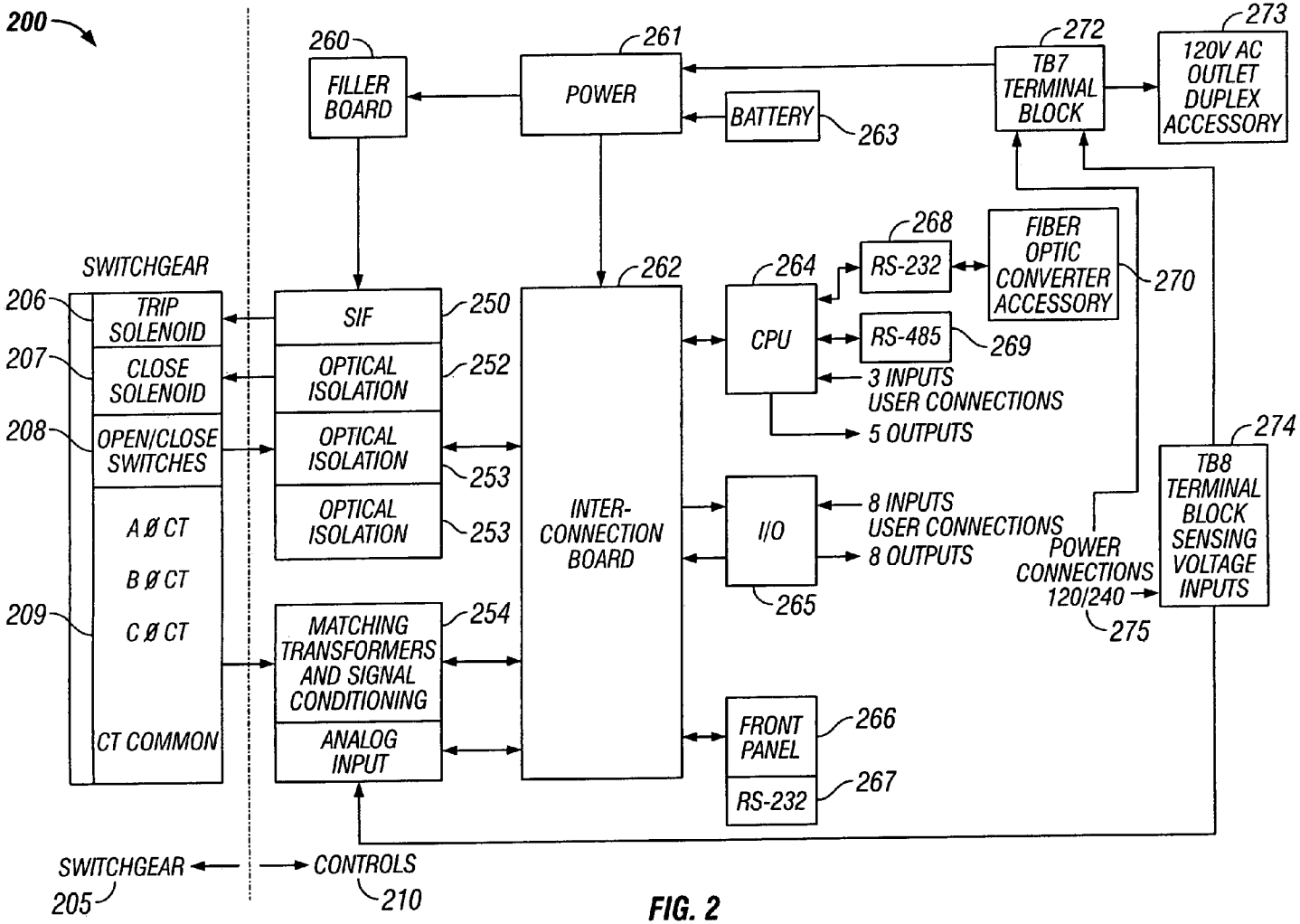
FIG. 2 PRIOR ART
FIG. 2 is a block diagram of a conventional switchgear and electronic controls.

Referring to FIG. 2, a conventional high voltage switchgear system 200 includes two sections: the switchgear 205 (e.g., the switchgear 105 of FIG. 1) and the electronic controls 210 (e.g., the electronic controls 110 of FIG. 1). The switchgear 205 contains a trip solenoid 206, a close solenoid 207, open and close switches 208, and current transformers (CTs) 209 that produce signals representative of the three phases (AØ, BØ, CØ) of the three phase voltage being controlled.

Certain components of the electronic controls 210 typically are used for surge protection when the switchgear 205 and the electronic controls 210 are physically separated. These surge protection components include, for example, a switchgear interface (SIF) 250 that controls the trip solenoid 206, optical isolation components 252 and 253 that interface with the close solenoid 207 and the open/close switches 208, and matching transformers and signal conditioning components 254 that receive and process signals from the CTs.

Also included in the electronic controls 210 is a filler board 260 that connects to the SIF 250 and a power supply 261. There is an interconnection board 262 that connects various components of the electronic controls 210, a battery 263 that inputs to the power supply 261, a central processing unit (CPU) 264 with multiple inputs and outputs for user connections, an input/output port 265 with multiple inputs and outputs for user connections, and a front panel 266 that is connected to a first RS-232 connection 267. A second RS-232 connection 268, and an RS-485 connection 269 both couple to the CPU 264. The electronic controls 210 also include a fiber optic converter accessory 270 that couples to the second RS-232 connection. A TB7 terminal block 272 outputs to a 120 V AC outlet duplex accessory 273 and to the power supply 261 and receives inputs from power connections 275 and a TB8 terminal block 274 that senses voltage inputs from the power connections 275.

Figure 3:
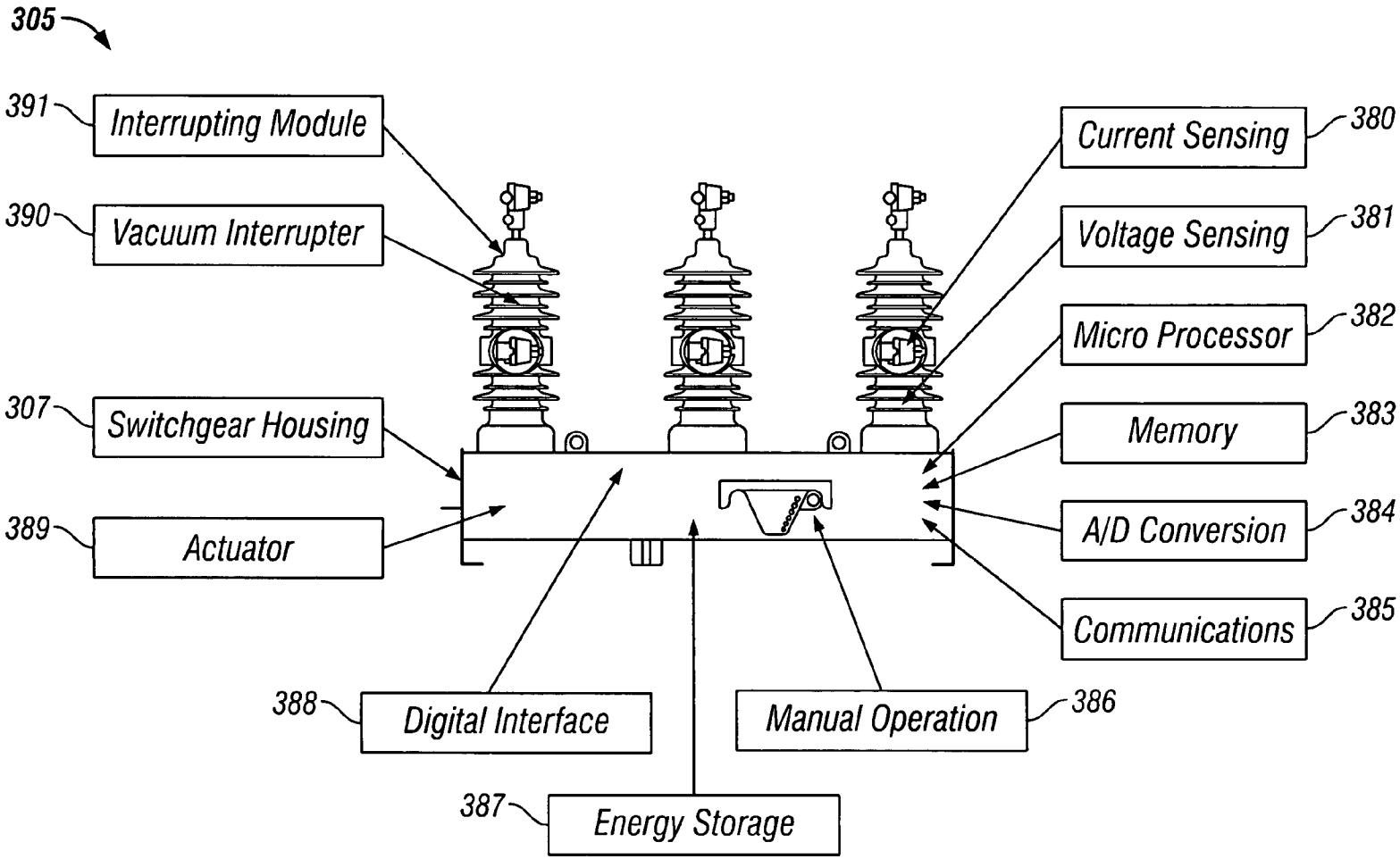
FIG. 3 is an illustration of a switchgear with embedded electronic controls.

Referring to FIG. 3, switchgear 305 includes embedded electronic controls. The switchgear 305 is used to manage the operation of a power distribution system, and is capable of interrupting high currents caused by power system faults. The switchgear 305 can also reclose the line after a fault has been cleared in order to find out if the fault was permanent or temporary. The switchgear 305 also is capable of communicating with a central utility control system using Supervisory Control And Data Acquisition (SCADA protocol) and coordinating its action with one or more neighboring switchgear devices for optimal line sectionalizing and automated system restoration.

In the switchgear 305, the electronic controls that previously were physically separated from the switchgear and located near the bottom of the utility pole are now contained within the switchgear housing 307, which may be located near the top of the utility pole as a single self-contained physical device. The switchgear housing 307 includes a current sensing device 380 (e.g., a CT) for each phase, a voltage sensing device 381 for each phase, a microprocessor 382, memory 383, an analog to digital converter 384, a communications device 385, manual operation device 386, energy storage device 387, a digital interface 388, an actuator 389, and an interrupting module 391 for each phase containing a vacuum interrupter 390, a current sensing device 380, and a voltage sensing device 381.

The vacuum interrupter 390 is the primary current interrupting device. The vacuum interrupter 390 uses movable contacts located in a vacuum that serves as an insulating and interrupting medium. The vacuum interrupter 390 is molded into the interrupting module 391, which is made from a cycloaliphatic, prefilled, epoxy casting resin and provides weather protection, insulation, and mechanical support to the vacuum interrupter 390. The lower half of the interrupting module 391 is occupied by a cavity that contains an operating rod that functions as a mechanical link for operating the vacuum interrupter.

Aside from the vacuum interrupters 390, the switchgear housing 307 is primarily used to house the vacuum interrupter operating mechanism and the actuator 389, which is the main source of motion. The switchgear housing 307 also may contain the other electronic controls necessary to measure the power system current and voltage, to make decisions about the status of the power system, to communicate with external devices, and to convert, store, and control energy necessary for moving the actuator 389.

Initially, current from the power system is brought through the high voltage terminals of the interrupting module 391. The current flows through the vacuum interrupter 390 and is measured by the current sensing device 380. The voltage sensing device 381 also may be within the interrupting module 391, either as part of the current sensing device 380 or within the cavity containing the operating rod. Voltage and current measurements are subsequently digitized by the analog-to-digital converter 384, processed by the microprocessor 382, and stored in memory 383.

If a predefined set of decision criteria is met, microprocessor 382 may decide to issue a command to open or close the vacuum interrupter 390. To do this, the microprocessor 382 first issues a command to an actuator control circuit, which in turn directs the energy from the energy storage device 387 into the actuator 389. The actuator 389 then creates force that is transmitted through the mechanical linkages to the operating rod in the cavity of the interrupting module 391. This force causes the operating rod to move, which in turn moves the movable contact of the vacuum interrupter 390, thus interrupting or establishing a high voltage circuit in the electrical system.

The energy storage device 387, which may be a battery, enables autonomous switchgear operation throughout power system faults and power outages. The energy storage device 387 may provide backup energy to the electronic controls, the communication device 385, and the switchgear mechanism, such as the actuator 389. By providing backup energy, the energy storage-device 387 enables the switchgear 305 to measure power system parameters, communicate with other switchgear units, make decisions, and perform actions, such as opening or closing the switchgear, necessary to restore power to the affected part of the power system. The energy storage device 387 may include a combination of conventional capacitor and supercapacitor or hypercapacitor storage technologies (e.g., electric double layer capacitor technology) with typical stored energy levels in the 50 to 1000 J range. Supercapacitor energy storage typically uses 10 to 300 F of capacitance operated at 2.5V, and provides backup power over a period of 30 to 300 seconds.

Also contained within the switchgear housing 307 is a digital interface 388 that is used to exchange data with a remote operator panel or to interface with remote devices. The digital interface 388 may include a Control Area Network (CAN) interface, or a fiber-optic based communication interface, such as one that employs serial communications over fiber optic or Ethernet.

The manual operation device 386 may be used to activate the mechanical linkages to the operating rods using a hot-stick so as to accomplish the open or close operations manually.

The communications device 385 may be used to interface with the central utility control centers through SCADA, to coordinate operation with neighboring switchgear, and to provide for remote management from an operator panel. The communications device 385 may include both long-range and short-range communications devices to facilitate the communications performed by the switchgear 305.

Having the electronic controls embedded with the switchgear 305 offers significant advantages with regards to surge susceptibility, cost, installation, and cabling requirements. In this configuration, the interfaces are contained within the switchgear housing 307, thus eliminating destructive potential differences between the sensors, such as current sensing device 380 and voltage sensing device 381, and the operating mechanism, such as actuator 389. The self-contained switchgear unit with an embedded electronic controls is cost effective because it only requires one housing instead of two housings as illustrated in the conventional system of FIG. 1. The decreased surge susceptibility also results in reduced maintenance time and expense. The self-contained nature of this configuration also eliminates the need for the cabling to run the full length of the pole between the electronic controls and the switchgear 305. This tight integration between the switchgear mechanism and the electronic controls enables providing the user with enhanced diagnostic and switchgear operation monitoring functions, such as motion profile logging, temperature monitoring, and contact life monitoring.

Figure 4:
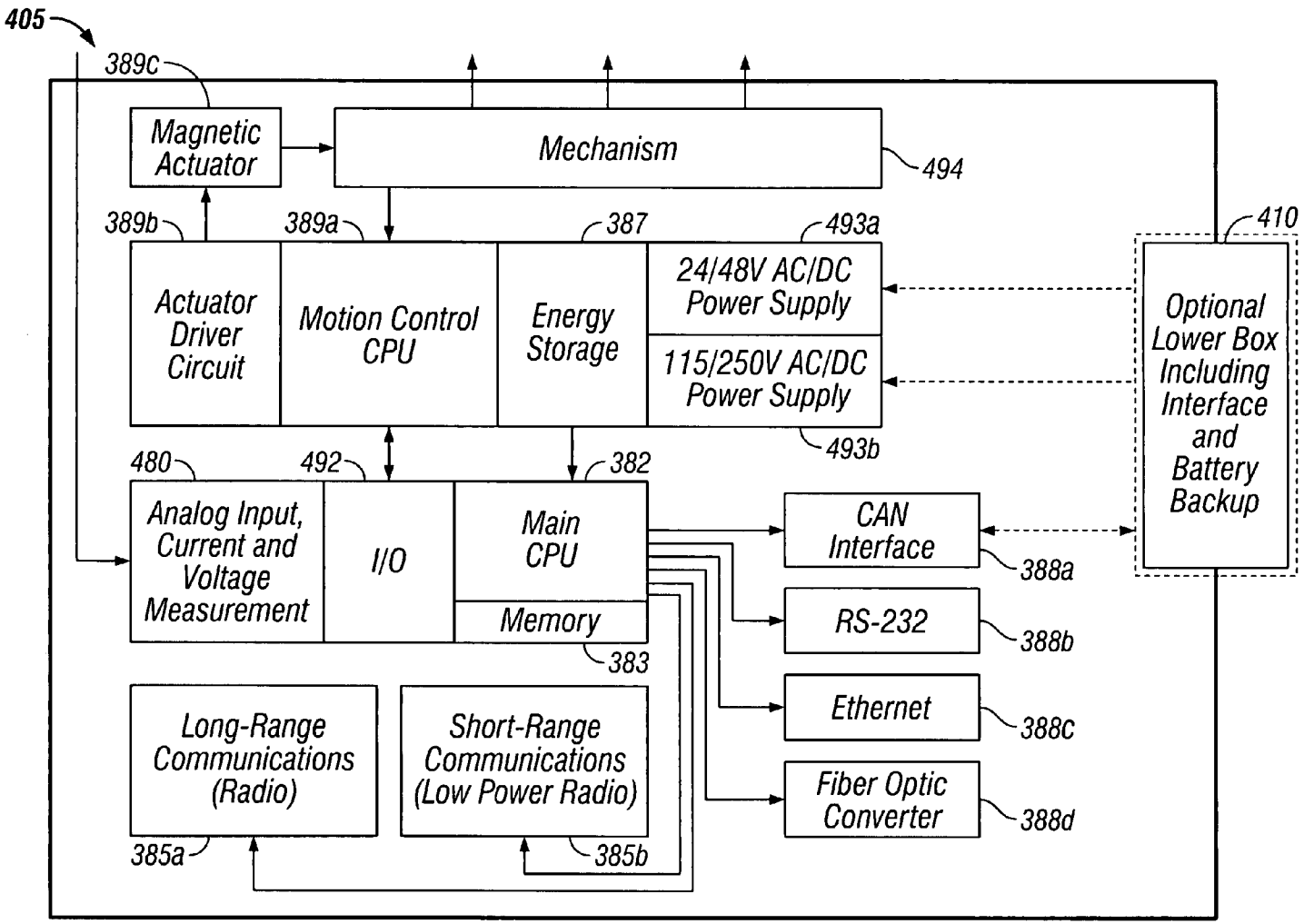
FIG. 4 is a block diagram of a switchgear with embedded electronic controls.

Referring to FIG. 4, the electronic controls of a switchgear 405 are embedded within the switchgear housing. The embedded electronic controls include an analog input, current and voltage measurement device 480, a main CPU 382, memory 383, a long-range communications device 385*a*, a short-range communications device 385*b*, an energy storage device 387, and an input/output device 492. Digital interfaces may include a Control Area Network (CAN) interface 388*a*, a RS-232 interface 388*b*, an Ethernet interface 388*c*, and a fiber optic converter interface 388*d*. The switchgear 405 also includes a motion control CPU 389*a* that outputs to an actuator driver circuit 389*b* that controls a magnetic actuator 389*c*. Collectively, the motion control CPU 389*a*, the actuator driver circuit 389*b*, and the magnetic actuator 389*c* form the actuator 389 of FIG. 3. The motion control CPU 389*a*, the actuator driver circuit 389*b*, and the actuator 389*c* drive the mechanism 494 of the switchgear 405. The switchgear 405 also includes a 24/48 V AC/DC power supply 493*a* and a 115/250 V AC/DC power supply 493*b*.

An optional lower box 410 separate from the switchgear 405 may be included at another location, such as the bottom of a utility pole. The optional lower box 410 may house an interface for enabling a user to monitor and control the switchgear 405 and/or a battery backup to supply additional backup power beyond the power provided by the embedded energy storage device 387.

Current from the electrical power system flows through the switchgear 405 and is measured by the analog input, current, and voltage measurement device 480, which also includes the analog-to-digital converter and corresponds to the current sensing device 380, the voltage sensing device 381, and the analog-to-digital converter 384 of FIG. 3. The electrical power system current and voltage are measured by the device 480 and the measurements are digitized by the analog-to-digital converter of the device 480. The digitized information is sent to the main CPU 382 and stored in memory 383, which correspond to microprocessor 382 and memory 383 of FIG. 3.

Based on the measurements, the main CPU 382 may decide to issue a command to open or close the vacuum interrupters 390 of FIG. 3. To do this, the main CPU 382 controls the motion control CPU 389*a* by way of the input/output device 492, which is used by the main CPU 382 to issue orders to adjoining circuits. The motion control CPU 389*a* then works with the actuator driver circuit 389*b* to control and deliver energy to the magnetic actuator 389*c*. The magnetic actuator 389*c* then causes the mechanism 494 to move. The mechanism 494 is connected to the operating rods in the lower cavities of the interrupting modules 391 of FIG. 3. The motion of the operating rod causes the vacuum interrupter 390 of FIG. 3 to open or close.

The CAN interface 388*a*, the RS-232 interface 388*b*, the Ethernet interface 388*c*, and the Fiber Optic Converter interface 388*d* correspond to digital interface 388 of FIG. 3. Other digital interfaces also may be used. The CAN interface 388*a* may be used to connect to electronic controls contained in the optional lower box 410, while the RS-232 interface 388*b* may be used as a programming and maintenance point. Both the Ethernet interface 388*c* and the fiber-optic converter 388*d* may be used for long distance communication such as over a wide area network (WAN), the Internet, or other communications network.

The long-range communications device 385*a* and the short-range communications device 385*b* correspond to the communications device 385 of FIG. 3. The long-range communications device 385*a* may be used to interface with central utility control centers through SCADA or to coordinate operation with neighboring protection devices. The short-range communications device 385*b* supplements the operation of the long-range communications device 385*a* by providing a remote device management functionality through a virtual, communications based operator panel. In one implementation, both communications devices 385*a* and 385*b* may be radios, with the short-range communications device 385*b* being a lower power radio.

The energy storage device 387, the 24/48 V AC/DC power supply 493*a*, and the 115/250 V AC/DC power supply 493*b* all supply backup energy that enables autonomous switchgear operation throughout power system faults and power outages. The 24/48 V AC/DC power supply 493*a* and the 115/250 V AC/DC power supply 493*b* both connect to the optional lower box 410 or some other external source.

Figure 5:
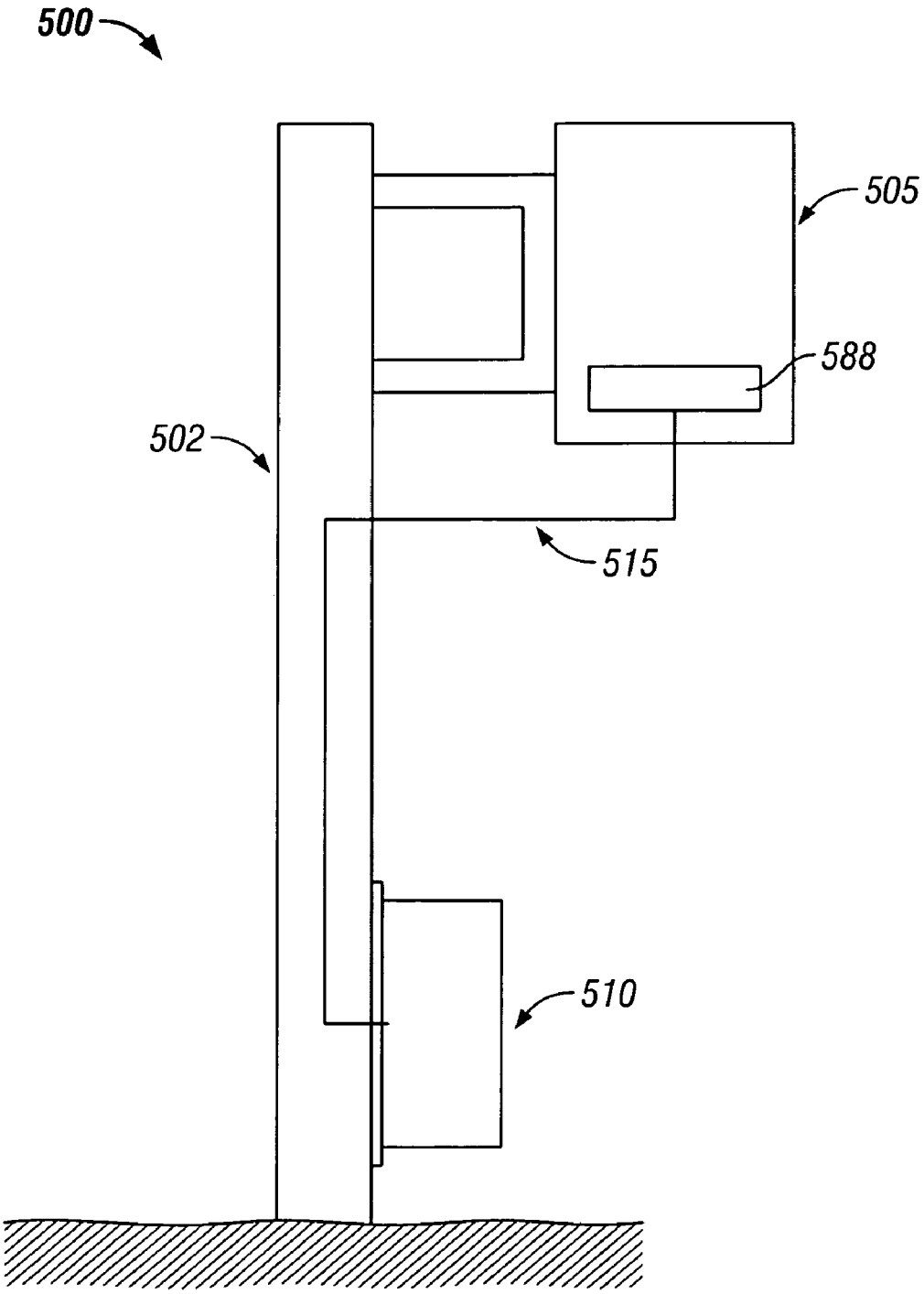
FIG. 5 is an illustration of a switchgear with embedded electronic controls and optional cabinet.

Referring to FIG. 5, an electrical system 500 includes switchgear 505 with an embedded electronic controls mounted near the top of a utility pole 502. In some implementations, a second cabinet 510 may be mounted at a location away from the switchgear 505, such as near the bottom of the utility pole 502. The second cabinet 510 may be required for operator access to optional accessories within the cabinet 510, including electronic controls. The electronic controls are connected to the switchgear 505 by the control cable 515. The control cable 515 connects to the switchgear 505 at the digital interface 588, which may be a CAN interface such as CAN interface 388*a* of FIG. 4, and the control cable 515 consists of only a single multi-conductor cable. As previously mentioned with respect to FIG. 1, while the conventional approach requires a new pair of wires for every additional function of the electronic controls, the digital interface 588 uses only a single wire pair to transfer all necessary digital information from the embedded electronic controls in switchgear 505 to an interface in the cabinet 510. Therefore, cost savings are achieved by using a digital data stream to communicate information between the switchgear 505 and the electronic controls instead of relying on a separate hard-wired connection for each function.

A second instance in which a second cabinet 510 may be employed is in applications that require the backup power time to be extended beyond the limits of the embedded energy storage device 387 of FIG. 4. The total backup time may be extended to 12 to 100 hours by adding a rechargeable battery to the second cabinet 510 and connecting that battery to the switchgear 505 at the 24/48 V AC/DC power supply 493*a* with the control cable 515. However, when compared to rechargeable batteries, the capacitor-based energy storage 387 offers an infinite number of charge/discharge cycles and eliminates the need for the maintenance or replacement normally associated with batteries. The total backup time can be extended indefinitely by adding to the cabinet 510 a means for connecting to a stable source of electricity, such as a substation battery or an uninterruptible power supply. In this case, the control cable 515 will connect from the lower cabinet 510 to the 115/250 V AC/DC power supply 493*b*.

In one exemplary implementation, the switchgear contains an embedded wireless communication link to enable a remote user to access the embedded electronic controls. For example, the wireless communication link may include a wireless transmitter and receiver, or transceiver using a radio frequency protocol such as, for example, Bluetooth, IEEE 802.11a standard wireless Ethernet protocol, IEEE 802.11b standard wireless Ethernet protocol, IEEE 802.11g standard wireless Ethernet protocol, fixed radio frequency protocol, and spread spectrum radio protocol. The remote user may communicate with the switchgear through the embedded wireless communication link using a remote controller, such as, a laptop computer, a notebook computer, a personal digital assistant (PDA), or other controller device that is capable of executing and responding to wireless communications.

It will be understood that various modifications may be made. For example, advantageous results still could be achieved if steps of the disclosed techniques were performed in a different order and/or if components in the disclosed systems were combined in a different manner and/or replaced or supplemented by other components. Accordingly, other implementations are within the scope of the following claims.

What is claimed is:

1. A system for controlling and monitoring a power distribution system, comprising:

a connection to a power line within the power distribution system;

a switchgear housing unit connected to the power distribution system and including a switchgear mechanism for controlling the connection;

electronic controls for monitoring and controlling the switchgear mechanism;

wherein the electronic controls are embedded within the switchgear housing unit to form a single, self-contained unit; and wherein the electronic controls include a digital interface configured to communicate control information for controlling the switchgear mechanism from the self-contained unit to another location using a single control cable.

2. The system of claim 1 wherein the electronic controls include an analog-to-digital conversion component that digitizes voltage and current waveforms within the switchgear housing unit.

3. The system of claim 2 wherein the digital interface receives input from the analog-to-digital conversion component to enable an operator to interface with the electronic controls.

4. The system of claim 2 further comprising:

a separate enclosure; and a digital interface that is housed in the separate enclosure and that is connected to the electronic controls embedded within the switchgear housing unit using a multi-conductor cable that provides electronic control signals to enable an operator to interface with the electronic controls.

5. The system of claim 4 wherein the electronic controls include an energy storage component embedded within the switchgear housing unit to provide backup power, the system further comprising a backup power element in the separate enclosure to extend a backup power time to operate the electronic controls and the switchgear mechanism during a power interruption.

6. The system of claim 1 wherein the electronic controls include an energy storage component embedded within the switchgear housing unit to provide backup power, the system further comprising a backup power element in the separate enclosure to extend a backup power time to operate the electronic controls and the switchgear mechanism during a power interruption.

7. The system of claim 1 wherein the electronic controls include a programming port to enable an operator to program the electronic controls.

8. The system of claim 1 wherein the electronic controls include:

a current sensing device to measure current in the power distribution system;

a voltage sensing device to measure voltage in the power distribution system;

an analog-to-digital converter to digitize the measured current and voltage;

a processor device to process the digitized current and voltage measurements; and a memory device to store the digitized current and voltage measurements.

9. The system of claim 1 wherein the switchgear housing unit and the embedded electronic controls are physically located near a top of a utility pole.

10. The system of claim 1 wherein the switchgear housing unit includes a manual operation device to operate the switchgear mechanism manually.

11. The system of claim 1 wherein the electronic controls include a first communications module and a second communications module to enable remote management of the switchgear mechanism, the first and second communication modules configured differently from one another.

12. The system of claim 1 wherein the switchgear housing unit includes a mechanism housing with one or more attached interrupter modules.

13. The system of claim 12 wherein the interrupter modules include one or more vacuum interrupters.

14. The system of claim 1 wherein the switchgear mechanism is configured to provide fault isolation to the power distribution system.

15. The system of claim 1 wherein the switchgear mechanism is configured to provide switching or tying operations between connections in the power distribution system.

16. The system of claim 1 wherein the switchgear mechanism is configured to open the connection in response to a fault within the power distribution system.

17. The system of claim 1 further comprising:

a separate enclosure; and a digital interface that is housed in the separate enclosure and that is connected to the electronic controls embedded within the switchgear housing unit using the single cable.

18. The system of claim 1 wherein the electronic controls include a first communications module and a second communications module to enable remote management of the switchgear mechanism, the first and second communication modules configured differently from one another.

19. A method for controlling and monitoring a power distribution system, the method comprising:

monitoring a connection to a power line within the power distribution system using electronic controls embedded within a switchgear housing unit;

controlling the connection to the power line within the power distribution system using the electronic controls embedded within the switchgear housing unit;

communicating, via a long range communications device of the electronic controls, with a central utility control system; and providing, via a short range communications device of the electronic controls, a remote device management functionality through a virtual communications based operator interface.

20. The method as in claim 19 further comprising:

measuring current and voltage of the power distribution system; and converting the current and voltage measurements to digital current and voltage measurements.

21. The method as in claim 19 further comprising:

providing backup power to the electronic controls using an energy storage module contained within the switchgear housing unit.

22. The method as in claim 21 further comprising:

extending a backup power time of the energy storage module with a separate backup power element located at another location from the switchgear.

23. The method as in claim 19 further comprising remotely operating the electronic controls using one of the short range and long range communications devices contained within the switchgear housing unit.

24. The method as in claim 19 further comprising manually operating a switchgear mechanism using a manual operation device contained within the switchgear housing unit.

25. A system for controlling and monitoring a power distribution system, comprising:

a connection to a power line within the power distribution system;

a switchgear housing unit mounted to a utility pole at a first location, the housing unit connected to the power distribution system and including a switchgear mechanism for controlling the connection;

electronic controls for monitoring and controlling the switchgear mechanism, the electronic controls being embedded within the switchgear housing unit to form a single, self-contained unit, and the electronic controls including a digital interface;

an enclosure, separately provided from the switchgear housing, mounted at a second location apart from the first location; and a single control cable establishing a prolonged connection to the embedded electronic controls in the switchgear housing, the single control cable communicating control information for operating the switchgear mechanism from the embedded electronic controls to the enclosure at the second location.

26. The system of claim 25 wherein the enclosure contains additional electronic controls having a digital interface, the single control cable connecting the digital interface of the embedded electronic controls and the digital interface of the additional electronic controls in the enclosure, the digital interface in the enclosure providing an operator interface with the embedded electronic controls at the first location.

27. The system of claim 25, wherein the first location is an upper portion of the utility pole, and the second location is a lower portion of the utility pole.

28. The system of claim 25, wherein the enclosure includes a backup power element at the second location.

29. The system of claim 25, wherein the electronic controls for monitoring and controlling the switchgear mechanism include a short range communications device and a long range communications device.

30. The system of claim 25, wherein the complete control information includes measured power system current and voltage for each phase of power being monitored, decision criteria for operating the switchgear mechanism, decision criteria for communicating with external devices, energy conversion and energy storage parameters for operating the switchgear mechanism, and control energy and decision criteria for moving a switchgear actuator to operate the switchgear mechanism.

* * * * *